US007503456B2

(12) United States Patent
Rodriguez

(10) Patent No.: US 7,503,456 B2
(45) Date of Patent: Mar. 17, 2009

(54) GIFT CONTAINER WITH DECORATIVE DISPLAY ELEMENT INCLUDED THEREIN

(76) Inventor: Melba Rodriguez, 19 Jackson Ct., San Antonio, TX (US) 78230

( * ) Notice: Subject to any disclaimer, the term of this patent is extended or adjusted under 35 U.S.C. 154(b) by 248 days.

(21) Appl. No.: 11/232,696

(22) Filed: Sep. 22, 2005

(65) Prior Publication Data

US 2006/0060488 A1 Mar. 23, 2006

Related U.S. Application Data

(60) Provisional application No. 60/676,829, filed on May 2, 2005, provisional application No. 60/612,078, filed on Sep. 22, 2004.

(51) Int. Cl.
*B65D 25/00* (2006.01)

(52) U.S. Cl. ..... 206/769; 206/457

(58) Field of Classification Search ..... 206/457, 206/232, 521, 217, 745, 756, 769, 770, 775, 206/776, 777
See application file for complete search history.

(56) References Cited

U.S. PATENT DOCUMENTS

| | | | | |
|---|---|---|---|---|
| 2,771,237 | A | 11/1956 | Philipson | |
| 3,595,382 | A | 7/1971 | Hofer | |
| 3,973,356 | A | 8/1976 | Schact | |
| 5,452,846 | A | 9/1995 | Meyers | |
| 5,458,235 | A * | 10/1995 | Stone | 206/232 |
| 5,762,191 | A | 6/1998 | Etzion | |
| 6,398,026 | B1 * | 6/2002 | Parsons | 206/349 |
| 6,422,388 | B1 * | 7/2002 | McCahey | 206/457 |
| 6,601,757 | B2 | 8/2003 | Bowman | |
| 6,766,902 | B1 * | 7/2004 | Hartelius | 206/217 |
| 2004/0055921 | A1 * | 3/2004 | Parsons | 206/472 |

* cited by examiner

*Primary Examiner*—Jacob K Ackun, Jr.

(57) ABSTRACT

A gift container with an integrated decorative display element is provided. The decorative element is adapted to be easily mounted upon the gift box to reduce the time and complexity involved in wrapping gifts. The decorative element may include mechanisms to quickly secure the gift box lid to the gift box container.

11 Claims, 9 Drawing Sheets

GIFT CONTAINER WITH DECORATIVE DISPLAY ELEMENT INCLUDED THEREIN

This application claims priority from U.S. Application No. 60/612,078 filed Sep. 22, 2004 and incorporates by reference the '078 application as if it were fully printed herein. This application also claims priority from U.S. Application No. 60/676,827 filed May 2, 2005 and incorporates by reference the '827 application as if it were fully printed herein.

FIELD OF THE INVENTION

Applicant's invention relates to a gift box container. More specifically, the present invention relates to a gift box container wherein all of the decorative and wrapping elements for the gift box are incorporated within the gift box container.

BACKGROUND OF THE INVENTION

Gift boxes are commonly used in connection with gift presentation. Most boxes include a lid and a container and may bear the logo or name of the vending establishment. Typically, the gift giver selects a decorative gift wrap that is placed around the box and then the wrapped box is decorated with a ribbon, bow and the like. To achieve a neatly presented gift wrapped package requires skill, discipline, and patience.

Furthermore, the task of wrapping a box typically proves time consuming (selecting paper, sizing, cutting, folding and taping) and somewhat wasteful of resources (paper, tape, etc.). In times of high volume gift purchasing, the prospect of taking the purchases home to wrap them adds to the stress of an already hectic shopping experience. To some challenged gift givers, the combination is almost unbearable.

For the "gift-wrapping challenged," the difficulty of gift wrapping may be somewhat alleviated by a pre-formed box. However, a pre-formed box of uniform dimensions still requires wrapping which can provide a less desirable appearance due to flaws in the wrapping technique. Therefore, the provision of a preformed, rigid box does not mitigate the challenge to the would-be gift wrapper.

Alternatives have appeared. For example, at peak gift giving times, e.g., the holiday season, a gift purchaser may turn for help to an available gift-wrap service. This act itself, may prove to be a challenge as the gift giver must contend with and negotiate long lines to avoid the gift wrapping task.

Recently, to assist consumers, rigid set up boxes incorporating coordinated designs corresponding to a desired motif (children's birthdays, Christmas, graduation, etc.) have become available. Such boxes facilitate time savings; however, unless secured, the lid of such a box may be dislodged from the underlying container to thereby expose the gift. Consequently, decorative gift boxes are often tied with a ribbon to secure the lid to the box container. Particularly in the case of a highly decorative, specialty box, the gift giver may forget to purchase a color-coordinated ribbon. Thus, even with a decorative gift box, the user may use a non-matching ribbon found in the user's home.

SUMMARY OF THE INVENTION

In accordance with the invention, a gift box container is provided which incorporates a lid, a container, and a decorative element. The gift box may vary in dimensions and shapes. The gift box may be assembled without the aid of tools and without the need to resort to fastening materials such as Scotch® brand tape. The gift box may be in the general shape of a cube or may be in any geometric form which may accommodate a gift. As delivered to the gift giver, the lid is in place on the container and the decorative element may be disposed within the container.

In one embodiment, when the gift giver wishes to wrap a gift, the gift giver removes the lid from the container and removes the decorative element. The decorative element is then inserted into the lid via an aperture in the lid and the decorative element is secured to the lid via a securing mechanism built into the interior side of the lid.

Once the gift is inserted into the container, the lid is replaced. The decorative element is typically comprised of at least two ribbons with tabs on the terminal ends thereof. Once the lid is in place on the container, the ribbons are extended downward along the side of the container and the tabs of the ribbons are inserted into slots on the base of the container. By this device, the lid is held securely onto the container and the completed, wrapped look of the gift is achieved.

The recipient of the gift opens the gift by extracting the ribbon tabs from the container slots and lifting the lid. Because no part of the gift box or ribbons are destroyed in this process, the gift box is reusable.

In another embodiment of the present invention, a self-decorated gift box is provided wherein the gift box contains a collapsible, pre-decorated lid inside a protected covered gift box. In this embodiment, the protective cover is removed and the collapsible decorated lid is removed from the container and disposed on the container to form a decorated gift box. On some number of sides of the decorated lid are ribbons with tabs on the distal ends thereof. Once the lid is in place on the container, the ribbons are extended downward along the side of the container and the tabs of the ribbons are inserted into slots on the base of the container.

In another embodiment of the invention, the decorative element consists of a decorative ribbon with a plurality ribbons extending from the base to secure the lid to the container. In other embodiments, the decorative element may consist of bows, ribbons, ornaments (e.g., Christmas, Easter, etc.), floral arrangements, fabric, toys, raffia, paper (e.g., tissue, arts & craft paper, etc.), jewelry, beads, model figurines (e.g., airplanes, cars, furniture, dolls, etc.), or any component or item that may be used as part of a decorative design.

In another embodiment of the invention, a rigid gift box is provided which incorporates a container, interchangeable decorative elements, and a lid adapted to receive the decorative elements. The decorative element is adapted to be secured to the gift box lid; for example, with plastic or metal latches adapted to engage the decorative element disposed along the outer edges of the gift box lid aperture. However, any standard means to attach on object to another, such as snaps, Velcro, or the like, is within the contemplation of the current invention. It is contemplated that the securing mechanism of the decorative element be of relatively standard and consistent size and placement across decorative elements such that decorative elements may be interchangeable among many sizes, shapes and styles of gift boxes. The decorative element may further comprise ribbons with tabs at the terminal ends thereof. Once the lid is in place on the container, the ribbons are extended downward along the sides of the container and the tabs of the ribbons are inserted into slots on the base of the container. By this device, the lid is held securing onto the container, the securing mechanisms are hidden from view, and the completed, wrapped look of the gift is achieved.

In another embodiment of the invention, a gift box is provided which incorporates a container, interchangeable decorative elements, and a lid further incorporating a shadow box. The shadow box is adapted to receive the decorative element. The decorative element may be adapted to be secured to the gift box lid via the latching mechanism described in the prior paragraph. In addition or in the alternative, the decorative element may comprise ribbons with tabs at the terminal ends thereof. Once the lid is in place on the container, the ribbons are extended downward along the sides of the container and the tabs of the ribbons are inserted into the slots on the base of the container. By this device, the lid is held securely onto the container, the securing mechanisms are hiding from view and the completed, wrapped look of the gift is achieved. In addition, in embodiments lacking the latching mechanisms, the tabbed ribbons also serve to secure the decorative element to the gift box lid. In either case, the shadow box provides additional lateral support.

In this embodiment, in addition to being stored within the gift box, it is also contemplated that the decorative element may also be comprised of fresh or dried flowers mounted onto a base. The base is placed into the shadow box and may be secured to the lid via the latching mechanisms or ribbons as described in the prior paragraph.

In another embodiment of the shadow box gift box, the decorative element may be stored entirely within the shadow box. The decorative element of this embodiment is collapsible or compressible such that it may be stored with the shadow box portion of the container lid. The shadow box opening is sealed such as with perforated paper or plastic. When the gift giver wishes to present a gift, the perforation of the sealed opening is breached and the decorative element is pulled through the resultant aperture. The decorative element may be comprised of ribbons with tabs on the distal ends thereof. Once the lid is in place on the container and the decorative element has been removed from the shadow box, if the decorative element includes ribbons, the ribbons are extended downward along the side of the container and the tabs of the ribbons are inserted into the slots on the base of the container. By this device, the lid is held securely onto the container and the completed, wrapped look of the gift is achieved.

DETAILED DESCRIPTION

Figure 1:
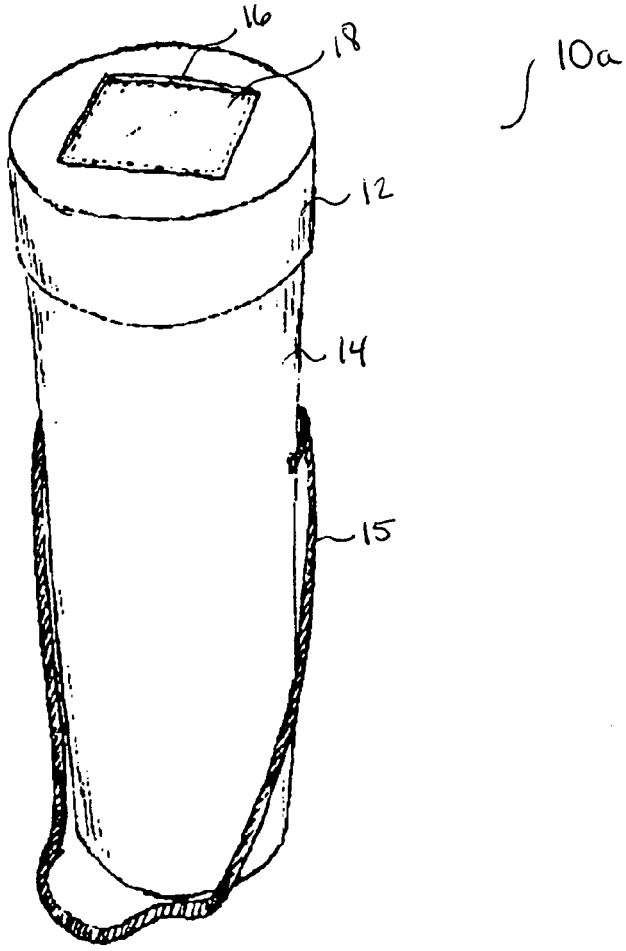
FIG. 1 is a perspective view of a an embodiment of the present invention in its delivered configuration.

Referring to the figures in which like referenced features indicate corresponding elements throughout the several views, attention is first directed to FIG. 1 which illustrates a first embodiment of the gift box container (10*a*) as delivered to a consumer with the lid (12) disposed atop the container (14). It is seen in this view that in this embodiment the lid (12) substantially conforms to the dimensions of the container (14). Although both the lid (12) and the container (14) are cylindrical in this embodiment, it is contemplated that each may take any configuration capable of being formed into a container. For example, square, rectangle, pentagon, octagon, etc.

On the upper surface of the lid (12) is seen an aperture (16). In this embodiment, the aperture (16) is removably sealed by a membrane (18). In the preferred embodiment, the membrane (18) is affixed to the lid (12) and is comprised of paper or easily torn plastic material, each of which may be perforated to allow easy access to the decorative element (20). The membrane (18) provides a view of and secures a decorative element (20) stored within the lid (12). In alternate embodiments, the membrane (18) may be opaque. An optional handle (15) is shown attached to the gift box container (14). The handle (15) may be composed of rope, string, ribbon, reed, or any other appropriate material.

Figure 2:
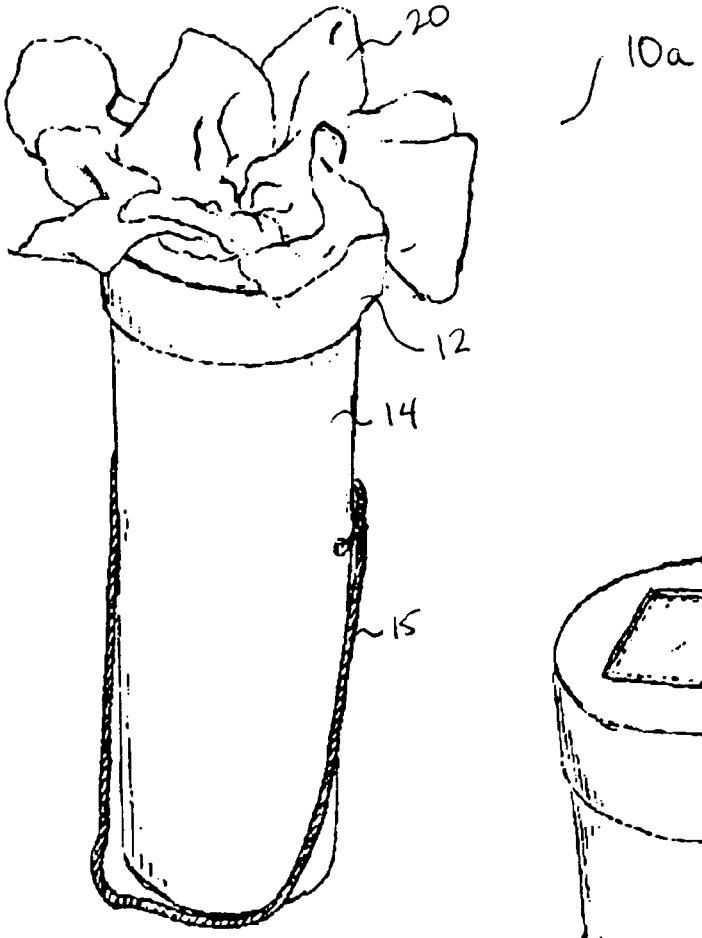
FIG. 2 is a perspective view of an embodiment of the present invention in its deployed configuration.

The decorative element (20) may be seen in FIG. 2 which illustrates a first embodiment of the gift box container (10*a*) with the decorative element (20) removed from the lid (12) and the gift box (10*a*) ready for delivery to a recipient. The decorative element (20) is secured to the base of a shadow box (24) disposed within the lid (12) to prevent accidental removal of the decorative element (20).

Figure 3A:
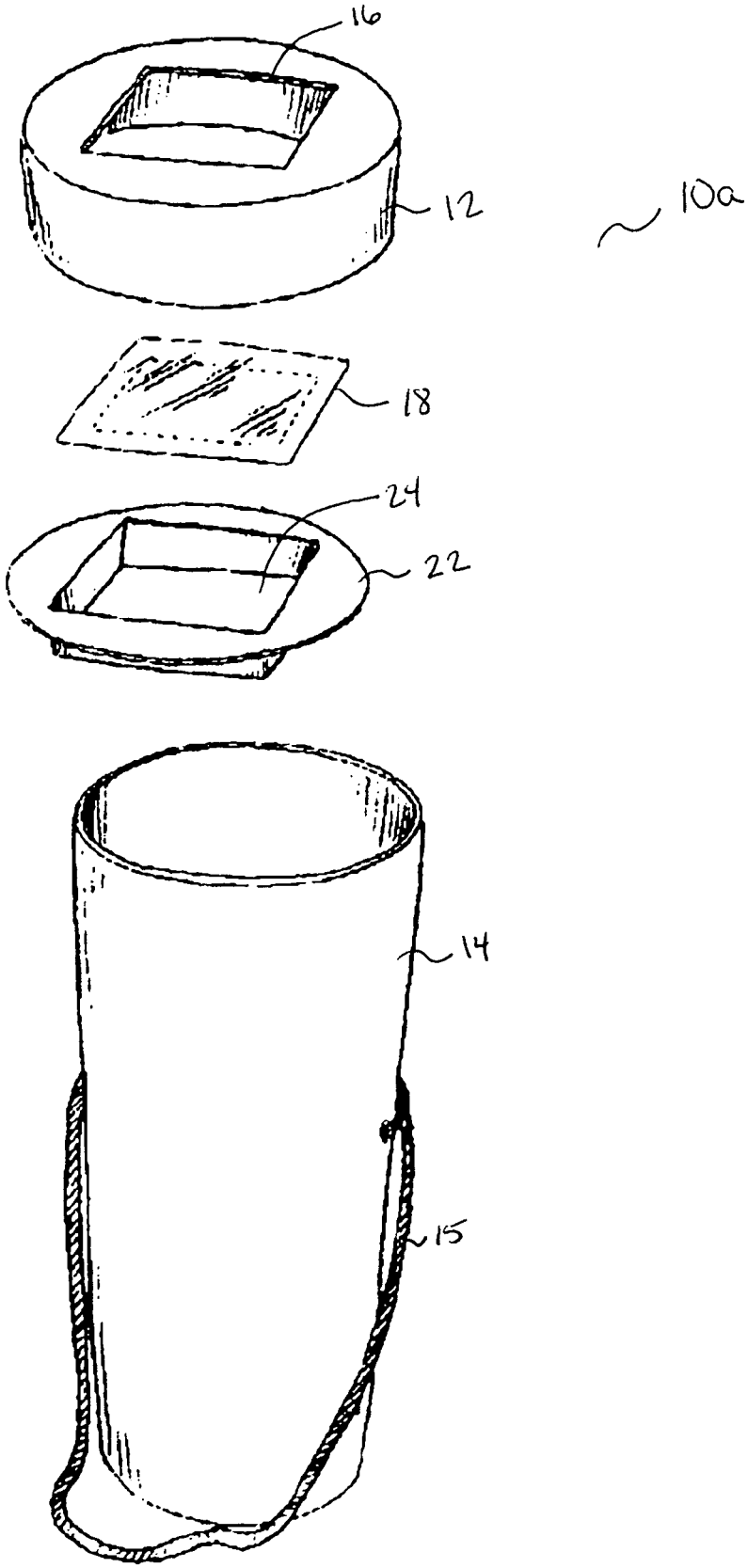
FIG. 3*a* is an exploded view of an embodiment of the present invention.
Figure 3B:
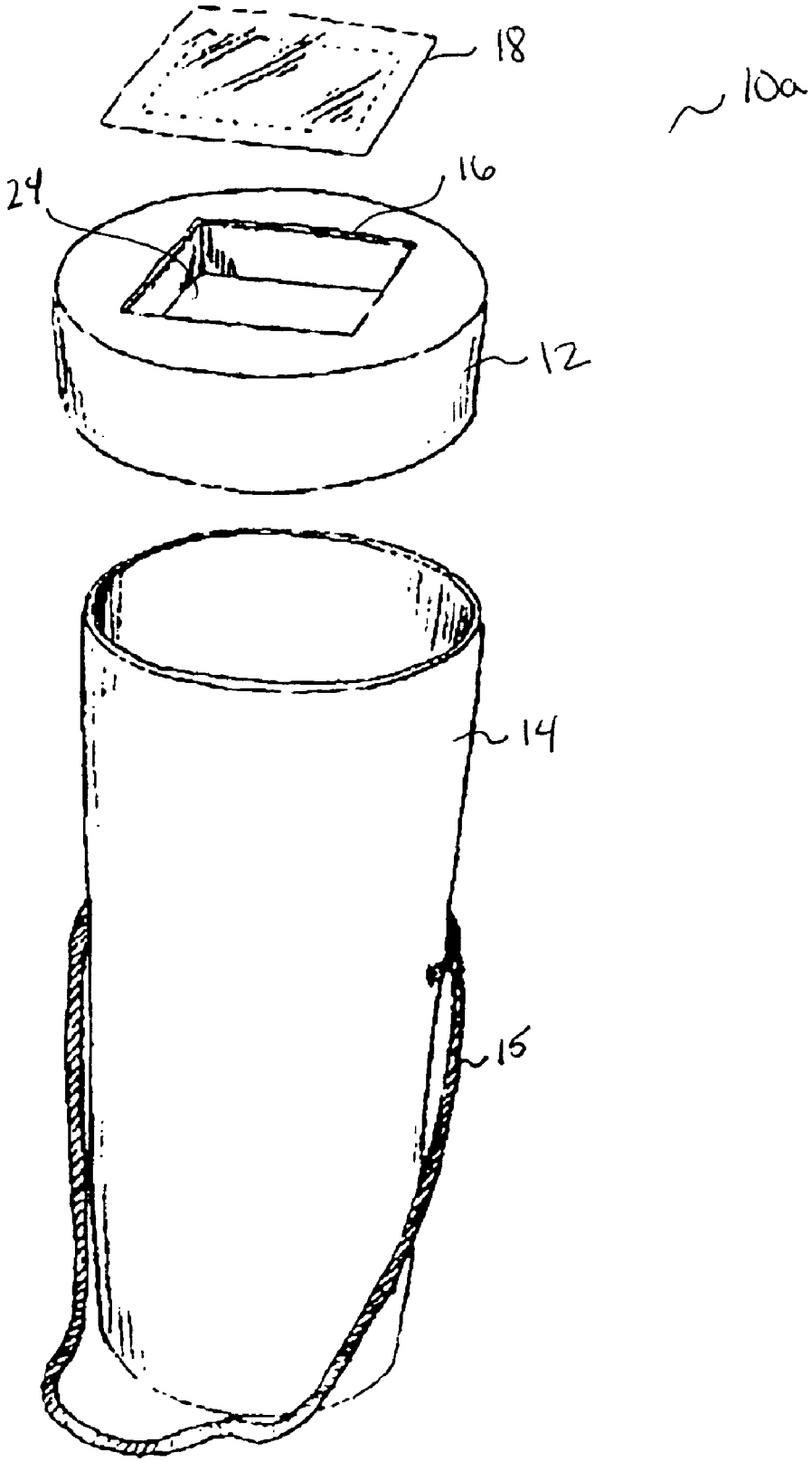
FIG. 3*b* is an exploded view of an embodiment of the present invention.

Referring now to FIGS. 3*a* and 3*b* which illustrate exploded views of the first embodiment of the gift box container (10*a*). It is seen in these figures that the membrane (18) may be affixed to the inner surface of the lid (12), FIG. 3*a*, or to the outer surface of the lid (12), FIG. 3*b*. In FIG. 3*a* is seen a shadow box insert (22) which incorporates a shadow box (24). The shadow box insert (22) is affixed to the inner surface of the lid (12) generally aligning the shadow box (24) with the lid aperture (16). Alternatively, as seen in FIG. 3*b*, the shadow box (24) may be fashioned on to the lid (12). In either configuration, the shadow box (24) stores the decorative element (20) for delivery and secures the decorative element (20) to the lid (12).

In this embodiment the decorative element (20) is comprised of material, such as silk or lace ribbon or any other appropriate material, which may easily collapse for storage within the shadow box (24) but has the resiliency to rebound to a fully formed decoration. In some embodiments, the decorative element (20) may incorporate ribbons with lengths generally of the height of the container (14) and tabs (28) at the terminal ends thereof to secure the lid (12) to the container (14). An example of such ribbons may be seen in FIG. 4, Item 26.

Figure 4:
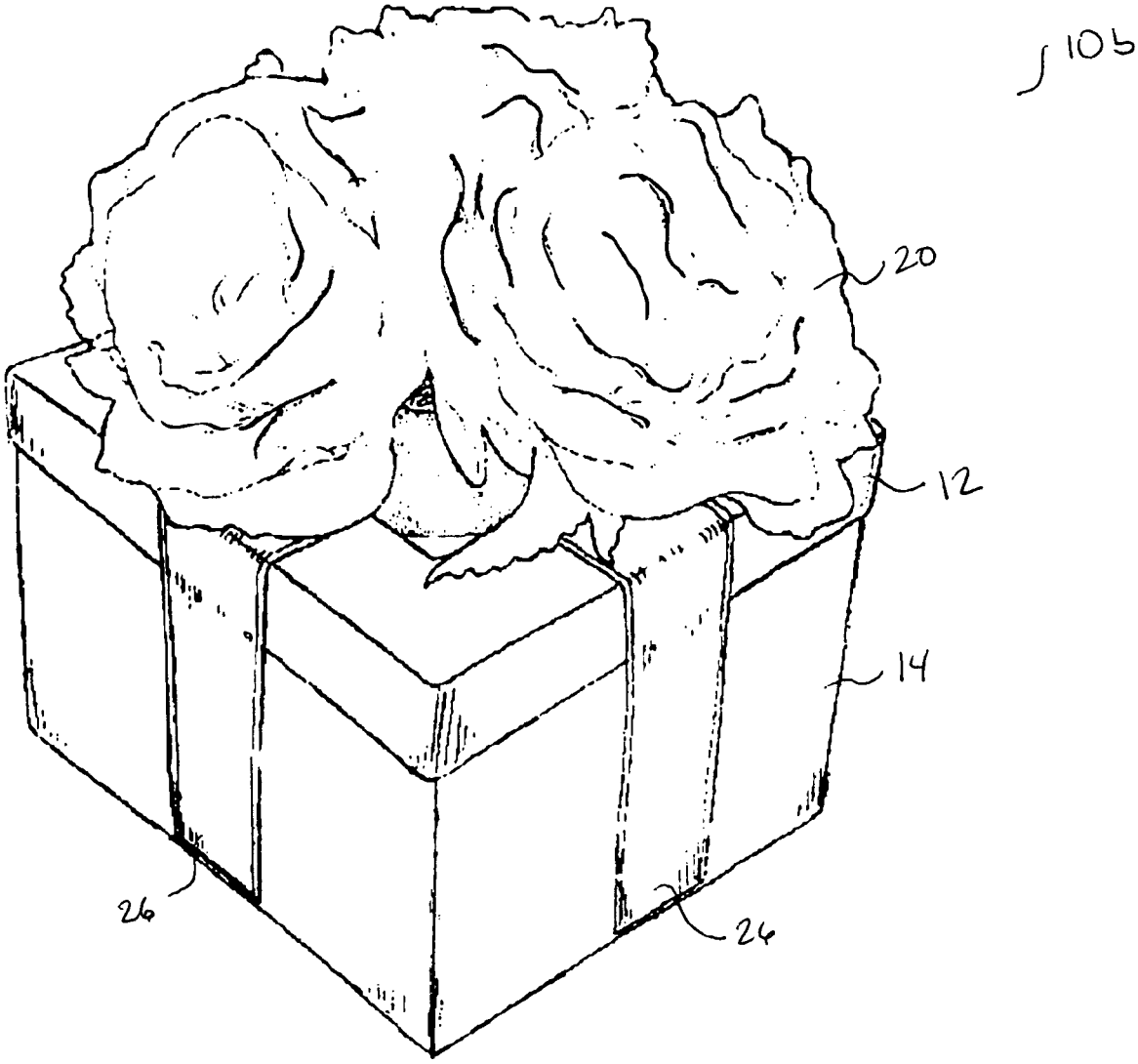
FIG. 4 is a perspective view of one embodiment of the present invention in its deployed configuration.

Referring now to FIG. 4 which illustrates another embodiment of the gift box container (10*b*). The gift box container (10*b*) as illustrated in FIG. 4 is shown in a generally rectangular configuration, however, other configurations are contemplated. In this figure it is seen a decorative element (20) atop the lid (12). As referenced in the prior paragraph, ribbons (26) are shown drawn along the sides of (14). The ribbons (26) may have tabs (28) to engage the ribbons with the container (14) or may engage their opposite member at a meeting point along the bottom of the container (14).

Figure 5A:
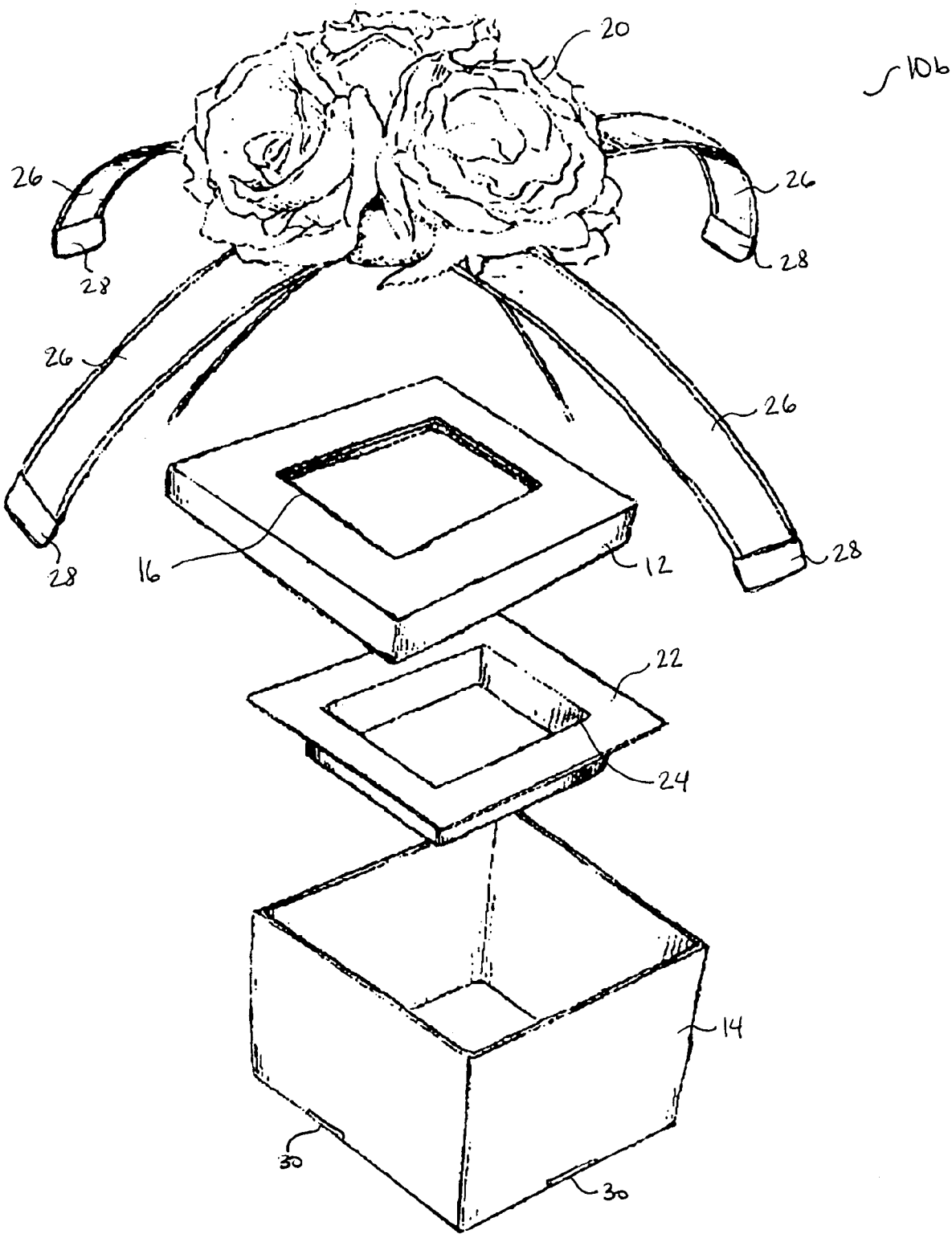
FIG. 5*a* is an exploded view of an embodiment of the present invention.
Figure 5B:
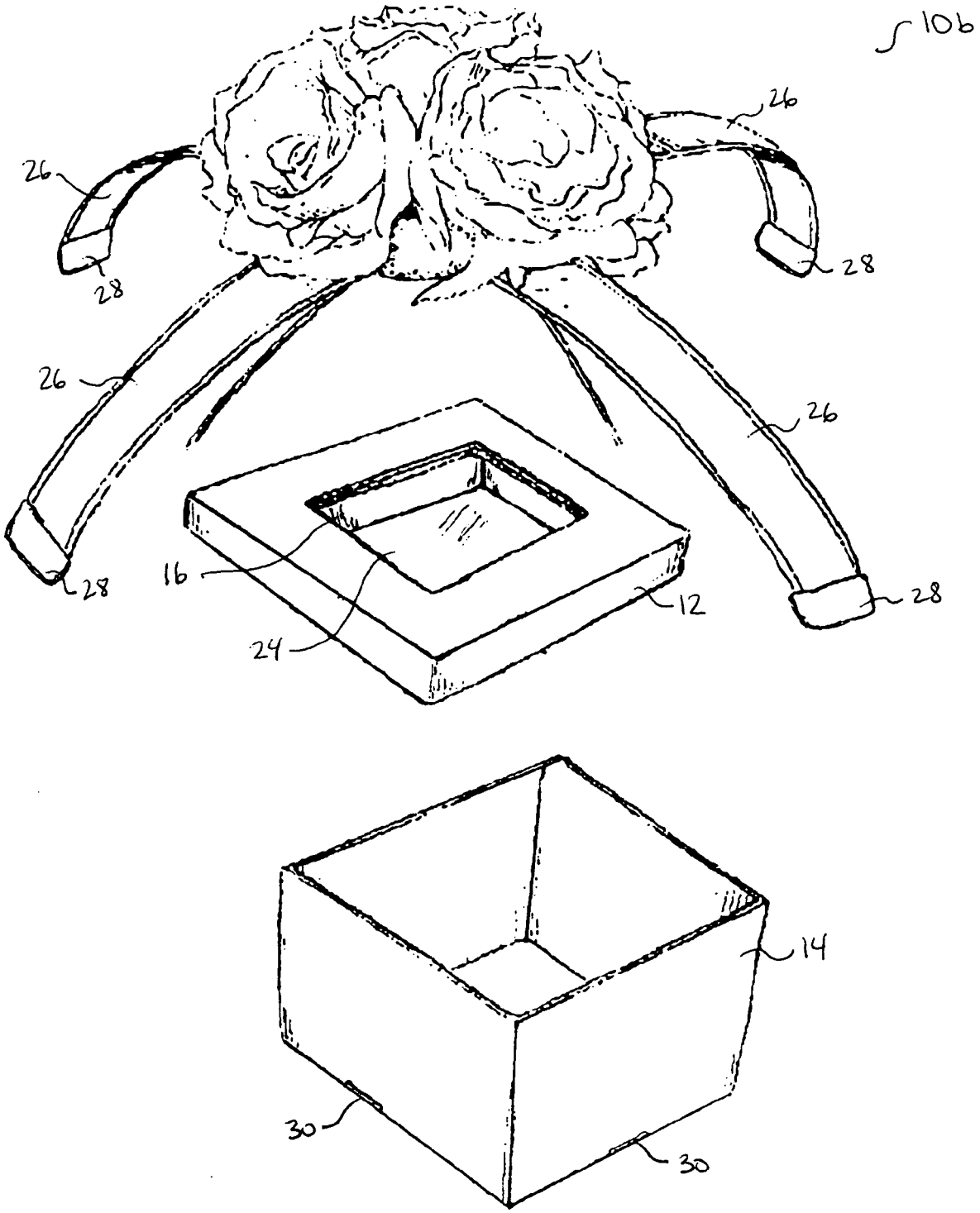
FIG. 5*b* is an exploded view of an embodiment of the present invention.
Figure 6:
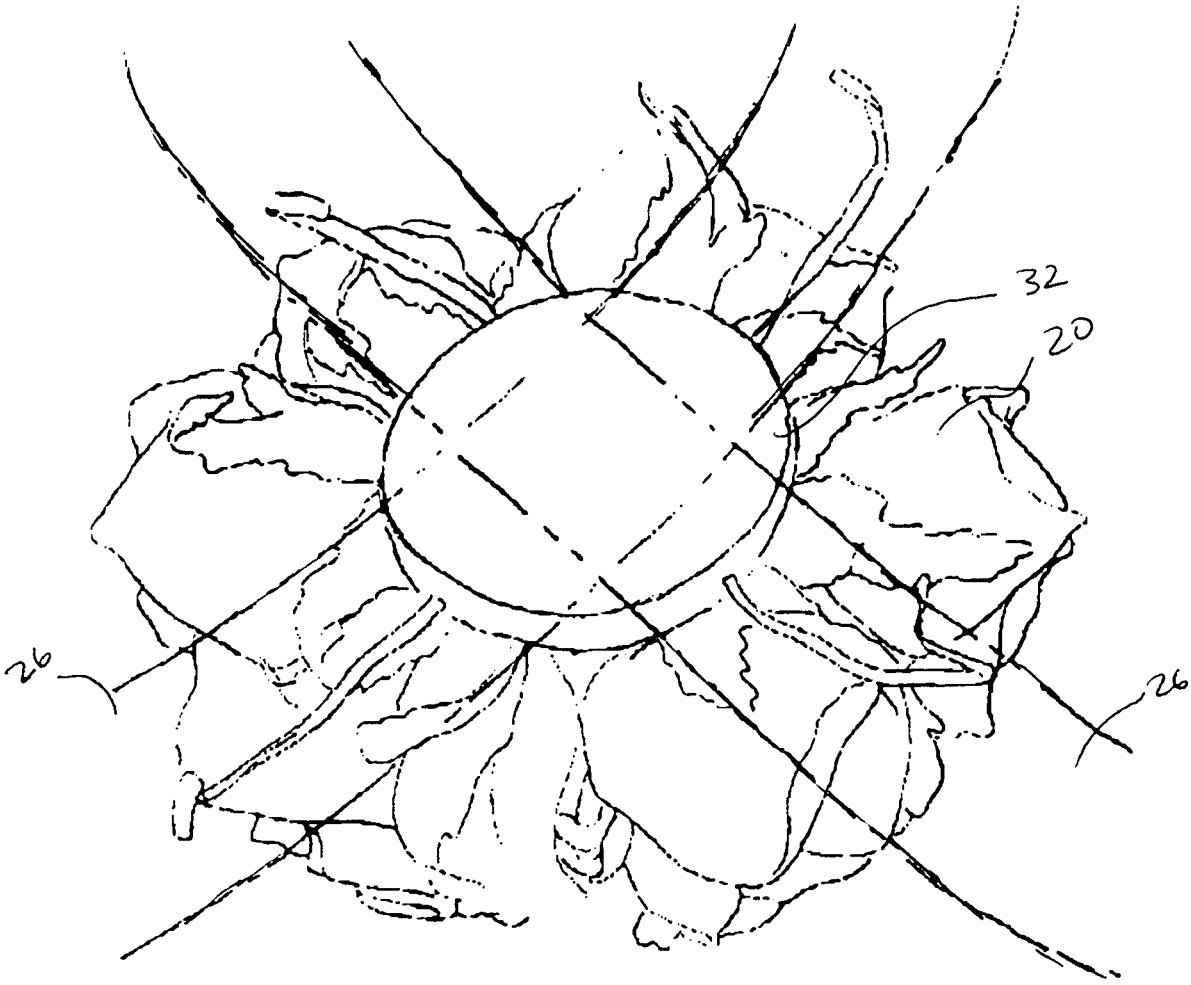
FIG. 6 is a perspective view of the underside of a decorative element of one embodiment of the present invention.
Figure 7:
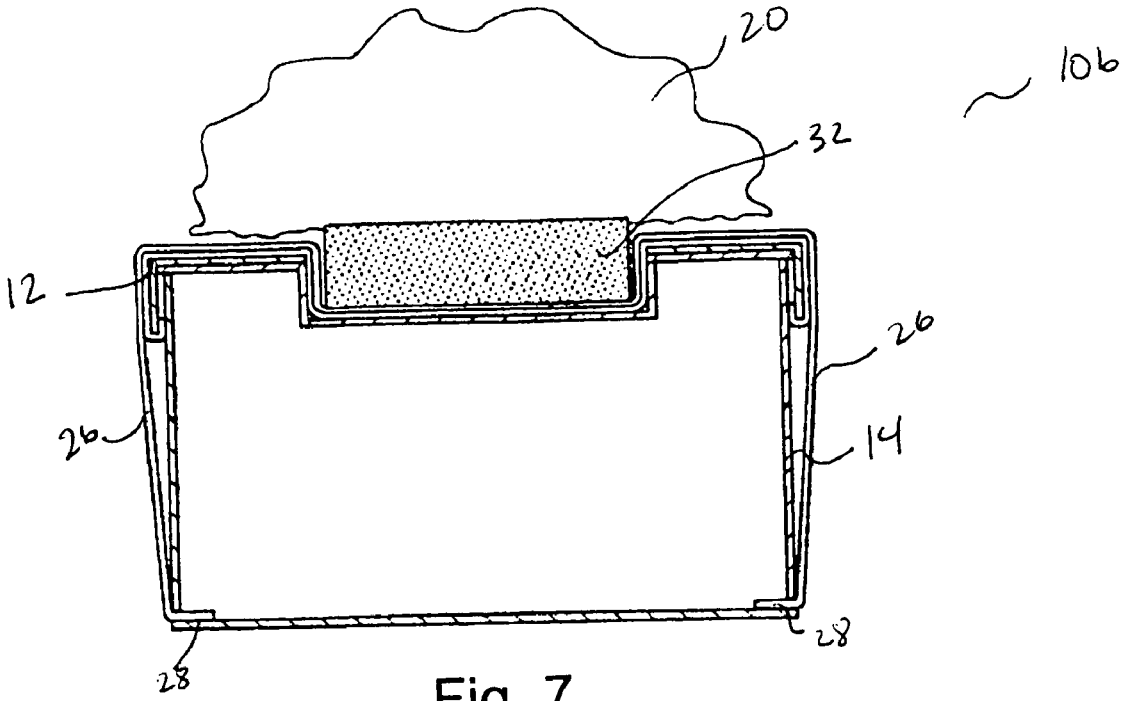
FIG. 7 is a section view of an embodiment of the present invention.

Referring now to FIGS. 5*a* and 5*b* which illustrate exploded views of the second embodiment of the gift box container (10*b*). In FIG. 5*a* is seen a shadow box insert (22) which incorporates a shadow box (24). The shadow box insert (22) is affixed to the inner surface of the lid (12) generally aligning the shadow box (24) with the lid aperture (16). Alternatively, as seen in FIG. 3*b*, the shadow box (24) may be fashioned on to the lid (12). In either configuration, the shadow box (24) is adapted to receive the decorative element (20) secure the decorative element (20) laterally to the lid (12).

In the embodiments of FIGS. 5*a* through 9, the decorative element (20) may be stored within the container (14) for delivery to the consumer or, alternatively, may be purchased separately from the gift box (10*b* and 10*c*). By this means, the decorative element (20) of the gift box (10*b* and 10*c*) may be exchanged to alter the presentation.

It is contemplated that the decorative element (20) may be comprised of live or dried flowers, artificial flowers, bows, toys, jewelry, beads, or any other decorative item which creates the appropriate mood for the gift-giving occasion. Where the decorative element (20) is comprised of live flowers, it is contemplated that base (32) of the decorative element (20) will be comprised of a sponge, see FIG. 6, or other like material which retains water, to ensure that the live flowers stay fresh for an extended period of time. It is further contemplated that the shadow box (24), may be comprised of a water-proof material to ensure that the gift is not damaged by water when the decorative element (20) is comprised of live flowers.

At the terminal ends of the ribbons (26) may be tabs (28). As seen in FIGS. 5*a* and 5*b*, the tabs (28) are adapted to be inserted into slots (30) when the decorative element (20) is in place in the shadow box (24) of the lid (12) and the lid (12) is in place on the container (14). This tab/slot arrangement serves the dual purpose of securing the lid (12) and decorative element (20) to the container (14) and providing a finished looked to the ribbons (26). As shown, the slots (30) are elongated slots within the side walls of the container (14).

Figure 8:
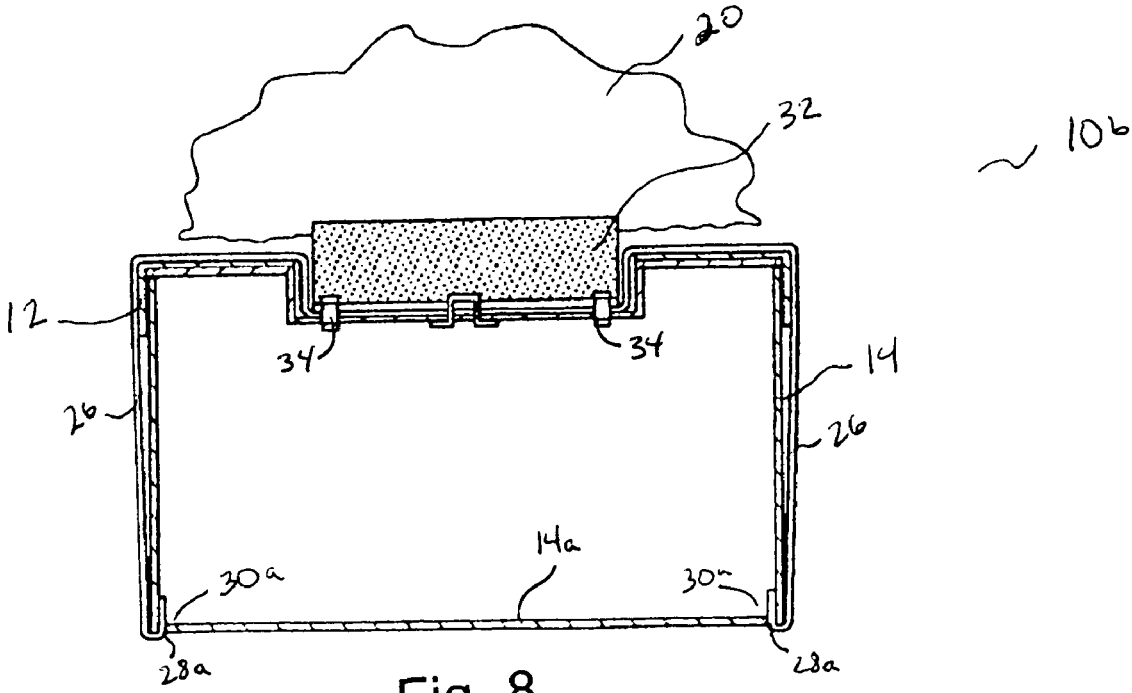
FIG. 8 is a section view of an embodiment of the present invention.

Referring now to FIG. 8, it is seen that other securing arrangements are contemplated such as providing elongated slots within the base of the container (14). In one alternative arrangement, the tabs (28*a*) are fashioned into generally U-shaped hooks. In this arrangement, the elongated slots (30*a*) are formed in the base (14*a*) of the container (14). It is also contemplated that the decorative element (20) may not include a ribbon. In this configuration, the decorative element (20) may be secured to the lid (12) by means of removable plastic snap rivets (34), Velcro® (not shown), or some other attachment means which allows for secure attachment but easy removal of the secured item.

Figure 9:
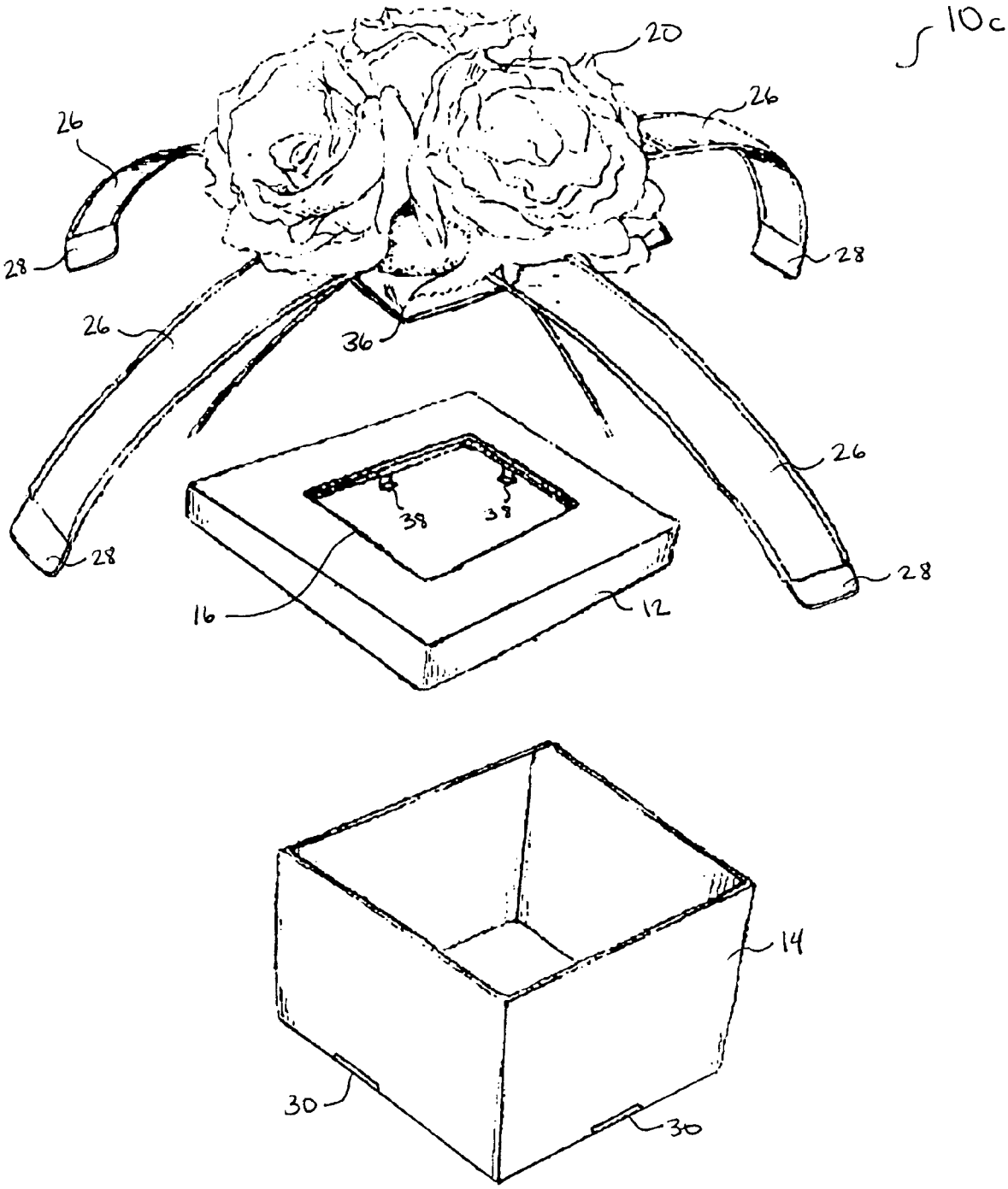
FIG. 9 is an exploded view of one embodiment of the present invention.

Referring now to FIG. 9 in which it is seen another embodiment of the gift box container (10*c*). The gift box container (10*c*) as illustrated in FIG. 9 is shown in a generally rectangular configuration, however, other configurations are contemplated. In this figure it is seen a decorative element (20), a lid (12) with an aperture (16), and a container (14). The decorative element (20) is fixedly mounted upon a generally flat base (36). Although shown in rectangular form, the base (36) of the decorative element (20) will substantially conform to the general dimensions of the aperture (16) but be sufficiently large such that the base (36) may not pass through the aperture (16).

As delivered to the consumer, the decorative element (20) is disposed within the container (14) and the lid (12) is in place over the open top of the container (14). To prepare the gift for presentation, the user pulls the decorative element (20) through the aperture (16), ensuring that the ribbons (26) are also pull through the aperture (16), until the decorative element base (36) comes into contact with the inner surface of the lid (12).

A plurality of securing elements (38) are disposed around the perimeter of the aperture (16) along the inner surface of the lid (12). It is expected that there will be at least two securing elements (38). In the preferred embodiment, the securing elements (38) are plastic tabs, however, it is also contemplated that any means of securing one surface to another, such as magnetic fasteners, peel-off adhesives, self-adhesive fasteners, foam clip fasteners, hooks, screw posts, rubber bands, clamps, Velcro®, snaps, tacks, prongs, buttons, glue (reusable or temporary, plastic, gel, acrylic, etc.), picture-frame swivel lock fasteners, tape (all types, mounting, magnetic, etc.), ties (all types; plastic, fabric, metal, etc.), wire, slots, double-sided tape, clips, push pins, rivets, bolts, or nuts.

At the terminal ends of the ribbons (26) are seen tabs (28). The tabs (28) are adapted to be inserted into slots (30) when the decorative element (20) is mounted to the lid (12) and the lid (12) is in place on the container (14). This tab/slot arrangement serves the dual purpose of securing the lid (12) and decorative element (20) to the container (14) and providing a finished looked to the ribbons (26). As shown, the slots (30) are elongated slots within the side walls of the container (14).

Although the invention has been described with reference to specific embodiments, this description is not meant to be construed in a limited sense. Any particular reference to a container shape or a securing mechanism is for illustrative purposes only and is intended to encompass alternate shapes and mechanisms. Various modifications of the disclosed embodiments, as well as alternative embodiments of the inventions will become apparent to persons skilled in the art upon the reference to the description of the invention. It is, therefore, contemplated that the disclosure will cover such modifications that fall within the scope of the invention.

The invention claimed is:

1. A gift container with an incorporated decorative element, the container comprising:

an open-topped receptacle, the receptacle comprised of an inner wall, an outer wall, a substantially flat base, and a plurality of elongated slots along the junction of the outer wall with the flat base;

a lid conforming to the dimensions of the top of the receptacle, the lid comprised of an inner wall, an outer wall, and a substantially flat top;

an aperture in the top of the lid;

a shadow box within the lid, the shadow box dimensions substantially matched to the aperture;

a removable decorative element, disposed within the receptacle, adapted to be inserted into the shadow box upon removal from the receptacle; and a plurality of ribbons of predetermined length comprising a securing mechanism to secure the decorative element within the shadow box and to secure the lid to the receptacle, the proximal ends of the ribbons attached to the base of the decorative element.

2. The gift container of claim 1 wherein the securing mechanism is comprised of tabs at the terminal ends of the ribbons adapted to be inserted into the plurality of elongated slots.

3. The gift container of claim 1 wherein the securing mechanism is comprised engagement means at the terminal ends of the ribbons adapted to engage one ribbon with its opposite member.

4. The gift container of claim 1 wherein the shadow box is composed of waterproof material.

5. The gift container of claim 4 wherein the waterproof material is plastic.

6. The gift container of claim 1 further comprising a handle engaged with the receptacle.

7. A gift container with an incorporated decorative element, the container comprising:

an open-topped receptacle, the receptacle comprised of an inner wall, an outer wall, a substantially flat base, and a plurality of elongated slots along the junction of the outer wall with the flat base;

a lid conforming to the dimensions of the top of the receptacle, the lid comprised of an inner wall, an outer wall, and a substantially flat top;

an aperture in the top of the lid;

a plurality of securing brackets on the inner surface of the top of the lid along the perimeter of the aperture;

a removable decorative element with a rigid base, disposed within the receptacle, adapted to be drawn through the aperture, the rigid base adapted to engage the brackets to secure the decorative element to the lid;

a plurality of ribbons of predetermined length to secure the lid to the receptacle, the proximal ends of the ribbons attached to the base of the decorative element, the terminal ends of the ribbons adapted to be inserted into the plurality of elongated slots;

a plurality of ribbons of predetermined length comprising a securing mechanism to secure the lid to the receptacle, the proximal ends of the ribbons attached to the base of the decorative element.

8. The gift container of claim 7 wherein the securing mechanism is comprised of tabs at the terminal ends of the ribbons adapted to be inserted into the plurality of elongated slots.

9. The gift container of claim 7 wherein the securing mechanism is comprised engagement means at the terminal ends of the ribbons adapted to engage one ribbon with its opposite member.

10. The gift container of claim 7 further comprising a handle engaged with the receptacle.

11. A gift container with an incorporated decorative element, the container comprising:

an open-topped receptacle, the receptacle comprised of an inner wall, an outer wall, and a substantially flat base, and a plurality of elongated slots along the junction of the outer wall and the base;

a lid conforming to the dimensions of the top of the receptacle, the lid comprised of an inner wall, an outer wall, and a substantially flat top, the lid adapted to cover and enclose the opened top of the receptacle;

an aperture in the top of the lid;

a transparent membrane covering the aperture, the membrane adapted to be removed or breached, wherein the membrane is perforated and is attached to the inner surface of the top of the lid;

an insert with a shadow box, the insert conforming to the dimensions of the top of the lid, the insert engaged with the inner surface of the top of the lid, the shadow box dimensions substantially matched to the aperture;

a decorative element within and attached to the shadow box, the decorative element adapted to be drawn through said aperture when the transparent membrane is removed or breached, the decorative element composed of ribbon material and further comprising a plurality of ribbons of predetermined length, the proximal ends of the ribbons attached to the decorative element, the terminal ends of the ribbons comprising tabs adapted to be inserted into the plurality of elongated slots; and a handle engaged with the receptacle.

* * * * *